US008152936B2

(12) United States Patent
Tsubokura et al.

(10) Patent No.: US 8,152,936 B2
(45) Date of Patent: Apr. 10, 2012

(54) RARE EARTH MAGNET

(75) Inventors: Taeko Tsubokura, Chuo-ku (JP); Makoto Iwasaki, Chuo-ku (JP); Makoto Nakane, Chuo-ku (JP); Fumitaka Baba, Chuo-ku (JP)

(73) Assignee: TDK Corporation, Chuo-ku, Tokyo (JP)

( * ) Notice: Subject to any disclaimer, the term of this patent is extended or adjusted under 35 U.S.C. 154(b) by 115 days.

(21) Appl. No.: 12/666,909

(22) PCT Filed: Jun. 27, 2008

(86) PCT No.: PCT/JP2008/061704

§ 371 (c)(1),
(2), (4) Date: Dec. 28, 2009

(87) PCT Pub. No.: WO2009/004994

PCT Pub. Date: Jan. 8, 2009

(65) Prior Publication Data

US 2010/0233016 A1 Sep. 16, 2010

(30) Foreign Application Priority Data

Jun. 29, 2007 (JP) ..... 2007-172789

(51) Int. Cl.
*H01F 1/057* (2006.01)

(52) U.S. Cl. ..... 148/302; 420/121; 420/83

(58) Field of Classification Search ..... None
See application file for complete search history.

(56) References Cited

U.S. PATENT DOCUMENTS

| | | | | |
|---|---|---|---|---|
| 6,296,720 | B1 | 10/2001 | Yamamato et al. | |
| 7,311,788 | B2 | 12/2007 | Nishizawa et al. | |
| 7,534,311 | B2 | 5/2009 | Tomizawa et al. | |
| 2004/0189426 | A1 * | 9/2004 | Hidaka et al. | 335/202 |
| 2006/0201585 | A1 * | 9/2006 | Tomizawa et al. | 148/302 |
| 2007/0102069 | A1 * | 5/2007 | Hidaka et al. | 148/302 |

FOREIGN PATENT DOCUMENTS

| | | |
|---|---|---|
| CN | 1258082 | 6/2000 |
| JP | 2006-295139 | * 10/2006 |
| JP | 2006-295140 | 10/2006 |
| WO | 2004/029995 | 4/2004 |
| WO | 2005/015580 | 2/2005 |

* cited by examiner

*Primary Examiner* — John Sheehan
(74) *Attorney, Agent, or Firm* — Drinker Biddle & Reath LLP

(57) ABSTRACT

There is provided a rare earth magnet with excellent Br and HcJ values. The rare earth magnet according to a preferred embodiment of the invention is characterized by being composed mainly of R (where R is at least one element selected from among rare earth elements including Y), B, Al, Cu, Zr, Co, O, C and Fe, wherein the content of each element is R: 25-34 wt %, B: 0.85-0.98 wt %, Al: 0.03-0.3 wt %, Cu: 0.01-0.15 wt %, Zr: 0.03-0.25 wt %, Co: ≦3 wt % (but not 0 wt %), O: ≦0.2 wt %, C: 0.03-0.15 wt % and Fe: remainder.

4 Claims, 6 Drawing Sheets

RARE EARTH MAGNET

TECHNICAL FIELD

The present invention relates to a rare earth magnet, and more specifically to a rare earth magnet having an R-T-B based composition.

BACKGROUND ART

Rare earth magnets having R-T-B (R=rare earth element, T=metal element such as Fe) systems exhibit excellent magnetic properties, and much research is being devoted to further improving their magnetic properties. The residual flux density (Br) and coercive force (HcJ) are commonly used as indicators of the magnetic properties of magnets, and a larger product of these factors (maximum energy product) is associated with magnets of superior magnetic properties.

The Br or HcJ value of a rare earth magnet is known to vary according to the composition. For example, Patent documents 1-3 disclose rare earth magnets having characteristic compositions for the purpose of improving the Br or HcJ value.

[Patent document 1] International Patent Publication No. WO 2004/029995

[Patent document 2] Japanese Unexamined Patent Publication No. 2000-234151

[Patent document 3] International Patent Publication No. WO 2005/015580

DISCLOSURE OF THE INVENTION

Problems to be Solved by the Invention

The uses of rare earth magnets have become multiple and varied in recent years, and demand is increasing for even higher magnetic properties than in the prior art. In light of these circumstances, a highly useful industrial advantage would be attained by even slight improvement in the magnetic properties Br and HcJ, and particularly Br.

The present invention has been accomplished in light of this situation, and its object is to provide a rare earth magnet with superior Br and HcJ values.

Means for Solving the Problems

In order to achieve the aforementioned object, the rare earth magnet of the invention is characterized by being composed mainly of R (where R is at least one element selected from among rare earth elements including Y), B, Al, Cu, Zr, Co, O, C and Fe, wherein the content of each element is R: 25-34 wt %, B: 0.85-0.98 wt %, Al: 0.03-0.3 wt %, Cu: 0.01-0.15 wt %, Zr: 0.03-0.25 wt %, Co: ≦3 wt % (but not 0 wt %), O: ≦0.2 wt %, C: 0.03-0.15 wt % and Fe: remainder.

The rare earth magnet of the invention is an R-T-B based rare earth magnet having a basic composition represented by $R_2T_{14}B$. The rare earth magnet of the invention having such a composition can exhibit a higher level of both Br and HcJ compared to the prior art. While the reason for this is not fully understood, it is conjectured to be as follows.

First of all, since the rare earth magnet of the invention has a lower B content (≦0.98 wt %) than the basic composition, there is no excess formation of a B-rich phase and the volume ratio of the main phase is relatively increased, creating a high Br content. Also, although a low B content normally leads to formation of a soft magnetic $R_2T_{17}$ phase and a lower HcJ value, the trace amount of Cu according to the invention inhibits deposition of the $R_2T_{17}$ phase, instead producing an $R_2T_{14}C$ phase which is effective for improving HcJ and Br. Moreover, since the rare earth magnet of the invention has an O content of no greater than 0.2 wt %, a thick liquid phase is present during firing, thus aiding dispersion of Cu and increasing the R-rich phase that is effective for HcJ. These factors are believed to be responsible for the excellent Br and HcJ values achieved by the rare earth magnet of the invention.

The rare earth magnet of the invention may also contain Ga as a major constituent element. Specifically, it may be a magnet characterized by being composed mainly of R (where R is at least one element selected from among rare earth elements including Y), B, Al, Cu, Zr, Co, O, C, Fe and Ga wherein the content of each element is R: 25-34 wt %, B: 0.85-0.98 wt %, Al: 0.03-0.3 wt %, Cu: 0.01-0.15 wt %, Zr: 0.03-0.25 wt %, Co: ≦3 wt % (but not 0 wt %), O: ≦0.2 wt %, C: 0.03-0.15 wt %, Ga: ≦0.2 wt % (but not 0 wt %) and Fe: remainder. The HcJ value can be further improved if Ga is also included.

EFFECT OF THE INVENTION

According to the invention, it is possible to provide a rare earth magnet with excellent Br and HcJ values.

BEST MODE FOR CARRYING OUT THE INVENTION

Figure 1:
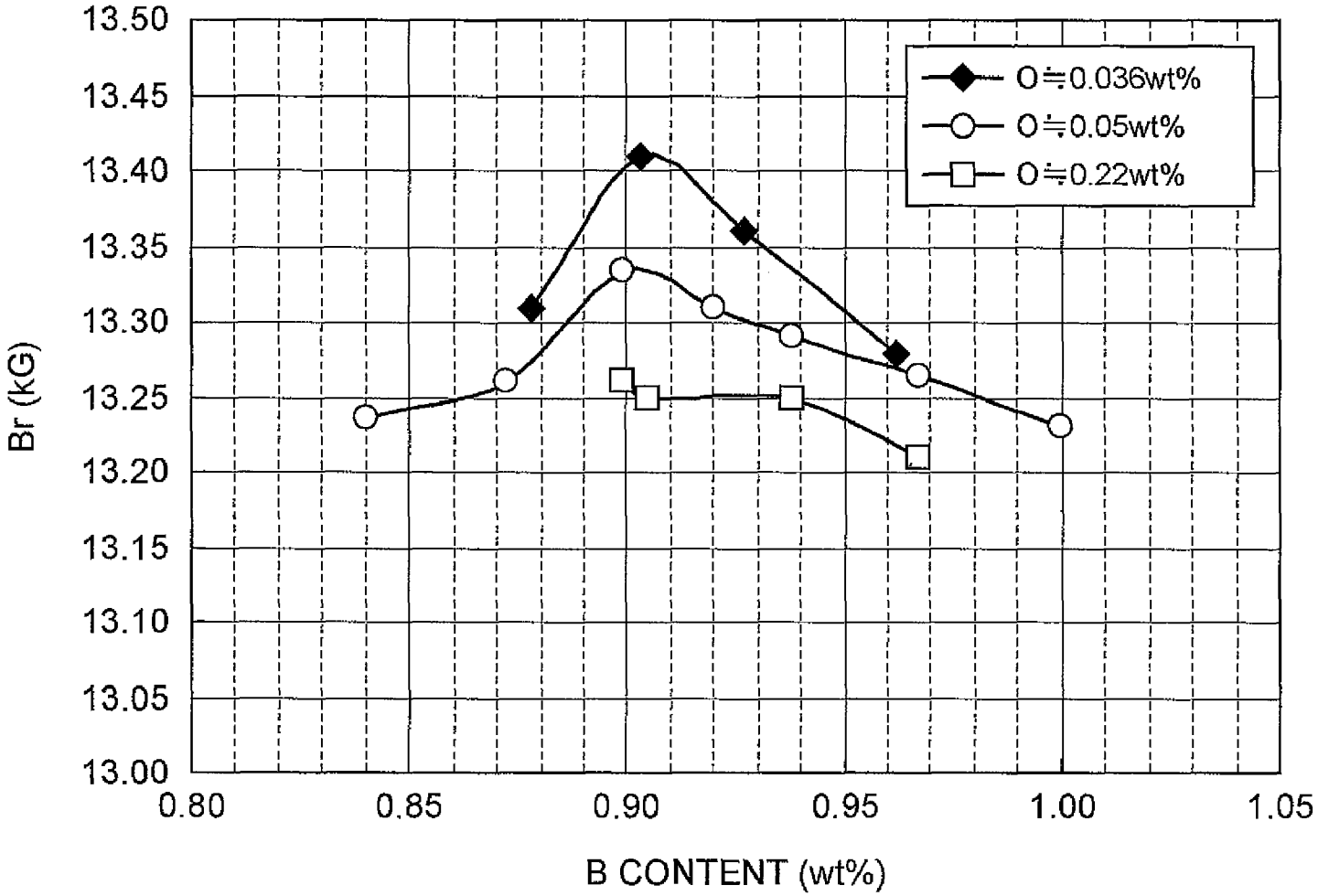
FIG. 1 is a graph showing a plot of Br values with respect to B content.

Preferred modes of the invention will now be explained.

A rare earth magnet according to a preferred embodiment of the invention is composed mainly of R, B, Al, Cu, Zr, Co, O, C and Fe, wherein the content of each element is R: 25-34 wt %, B: 0.85-0.98 wt %, Al: 0.03-0.3 wt %, Cu: 0.01-0.15 wt %, Zr: 0.03-0.25 wt %, Co: ≦3 wt % (but not 0 wt %), O: ≦0.2 wt %, C: 0.03-0.15 wt % and Fe: remainder.

A rare earth magnet "composed mainly of R, B, Al, Cu, Zr, Co, O, C and Fe" is a rare earth magnet that is composed only of these elements except for unavoidable impurities that are unintentionally included during production. The rare earth magnet of this embodiment may include, in addition to the essential constituent elements mentioned above, also unavoidable impurities such as Mn, Ca, Ni, Si, Cl, S or F at about 0.001-0.5 wt %.

The rare earth magnet of this embodiment having the composition described above is composed of a granular main phase having a tetragonal crystal structure represented by $R_2T_{14}B$, and a grain boundary phase situated between each main phase. The grain boundary phase contains, for example, an R-rich phase with a large R element content, and a B-rich phase with a large B content. The symbol T represents mainly Fe and Co among the constituent elements mentioned above. The other elements in the rare earth magnet may be present in both the main phase and grain boundary as added components.

Of the constituent elements of the rare earth magnet, R is at least one element selected from among rare earth elements including Y, and there may be mentioned one or more elements selected from the group consisting of La, Ce, Pr, Nd, Sm, Eu, Gd, Tb, Dy, Ho, Er, Yb, Lu and Y. R preferably includes Nd or Dy as an essential component.

The R content of the rare earth magnet is 25-34 wt %. If the R content is less than 25 wt % it will be difficult to form the $R_2T_{14}B$ phase as the main phase, while a soft magnetic α-Fe phase will tend to be formed instead, thus lowering the HcJ value. If it exceeds 34 wt %, on the other hand, the volume ratio of the $R_2T_{14}B$ phase will be reduced, thus lowering the Br value. Also, R will tend to react with oxygen thus excessively increasing the oxygen content, while the R-rich phase that contributes to HcJ will also be reduced, thus lowering the HcJ value. From the viewpoint of obtaining satisfactory Br and HcJ values, the lower limit for the R content is more preferably 28 wt % and the upper limit is more preferably 30 wt %. An R content of no greater than 30 wt % will increase the volume ratio of the $R_2T_{14}B$ phase as the main phase, thus resulting in a satisfactory Br value.

As mentioned above, R is preferably Nd or Dy. A $Dy_2T_{14}B$ phase is particularly effective for improving the HcJ value since it has a high anisotropic magnetic field. However, since an overly abundant $Dy_2T_{14}B$ phase will tend to lower the Br value, the Dy content is preferably 0.1-8 wt %, with the remainder consisting of other rare earth elements (especially Nd). The Dy content is preferably 0.1-3.5 wt % for a high Br value, and preferably 3.5-8 wt % for a high HcJ value.

The B (boron) content of the rare earth magnet is 0.85-0.98 wt %. A B content of less than 0.85 wt % will tend to result in deposition of the soft magnetic $R_2T_{17}$ phase in the grain boundary phase, thus lowering the HcJ value. At greater than 0.98 wt %, on the other hand, the B-rich phase (for example, $Nd_{1.1}T_4B_4$) will be excessively formed, resulting in an insufficient Br value. With these considerations, the B content is preferably 0.86-0.98 wt % and more preferably 0.90-0.94 wt %.

In the rare earth magnet of this embodiment, the B content is slightly lower than the stoichiometric ratio of the basic composition represented by $R_2T_{14}B$ in order to prevent formation of virtually any B-rich phase, and the volume ratio of the main phase is increased to permit a higher Br content. In most conventional production of R-T-B based rare earth magnets it has been common to form a B-rich phase to prevent abnormal grain growth, but according to this embodiment, the aforementioned optimal amount of Zr is included while reducing the O content to below the normal level, thus allowing abnormal grain growth to be inhibited while avoiding formation of a B-rich phase. As a result, a more homogeneous and fine structure is produced, and a rare earth magnet with excellent magnetic properties can be obtained.

The rare earth magnet contains Co (cobalt) in addition to Fe (iron) as the element represented by T in the basic composition of $R_2T_{14}B$, and the Co content is greater than 0 wt % and no greater than 3 wt %. Co forms a phase similar to Fe, but including a Co-containing phase increases the Curie temperature of the rare earth magnet while also improving the corrosion resistance of the grain boundary phase.

The rare earth magnet further contains Al (aluminum) and Cu (copper) as essential added elements. Including these elements improves the HcJ, corrosion resistance and temperature characteristics of the rare earth magnet. The Al content is 0.03-0.3 wt %. Also, the Cu content is 0.01-0.15 wt %.

Conventionally, a low B content has led to deposition of a soft magnetic $R_2T_{17}$ phase in the grain boundary phase and a lower HcJ value, but according to this embodiment, addition of Cu inhibits deposition of the $R_2T_{17}$ phase by, for example, facilitating deposition of the $R_2T_{14}C$ phase, thereby helping to maintain a satisfactory HcJ value. This effect of Cu tends to be exhibited more prominently with the B content according to this embodiment. This effect is not adequately obtained if the Cu content is less than 0.01 wt % or greater than 0.15 wt %, while the Br content is also reduced when it is less than 0.01 wt %. The Cu content is more preferably 0.03-0.11 wt %.

The O (oxygen) content of the rare earth magnet of this embodiment is 0.2 wt % or lower, and O may even be absent. If the O content exceeds 0.2 wt %, the proportion of the non-magnetic oxide phase will be increased, thus lowering the Br or HcJ value. When the B content is less than the stoichiometric ratio and the composition contains Cu, as in the rare earth magnet of this embodiment, a particularly notable effect of improved magnetic properties is obtained by such a low oxygen content.

In addition, if the B content is below the stoichiometric ratio to essentially eliminate a B-rich ($R_1T_4B_4$) phase, and the liquid phase volume during firing is increased by a low oxygen content, the sinterability during firing will be altered and the obtained rare earth magnet will undergo sufficient sintering even in the low temperature range. As a result, the rare earth magnet of this embodiment will have a fine post-sintering crystal grain size, which will also contribute to a high HcJ.

Although the O content is preferably as low as possible from the viewpoint of the improving the magnetic properties, under normal circumstances O will be unavoidably incorporated into the rare earth magnet by oxygen in the air during production, making it difficult to completely eliminate O. The lower limit for the O content will therefore generally be about 0.03 wt % and more preferably about 0.005 wt %. Incidentally, since including O can prevent oversintering and can sometimes result in excellent rectangularity, the lower limit for the O content is preferably in this range from the viewpoint of satisfactorily obtaining such properties. A more preferred O content range is 0.03-0.1 wt %. From these considerations, the O content is even more preferably 0.03-0.07 wt % and most preferably 0.03-0.04 wt %.

The rare earth magnet of this embodiment also contains Zr (zirconium) at 0.03-0.25 wt %. Zr can inhibit abnormal growth of the crystal grains during the rare earth magnet production process, thus resulting in a more homogeneous and fine structure of the obtained sintered body (rare earth magnet) and contributing to improved magnetic properties. This effect of Zr is especially notable when the O content is low (0.2 wt % or lower) as according to this embodiment.

If the Zr content is less than 0.03 wt %, an adequate effect of inhibiting abnormal growth of the crystal grain will not be obtained, and the squareness ratio of the rare earth magnet will be reduced. If it exceeds 0.25 wt %, on the other hand, the Br and HcJ values of the rare earth magnet will not be sufficient. The "squareness ratio" is the value represented by Hk/HcJ, where Bk is the magnetic field intensity when the magnetization in the second quadrant of the magnetic hysteresis loop (4πI-H curve) is 90% of Br. The squareness ratio is a parameter indicating the ease of demagnetization due to external magnetic field effects and temperature increase, and a small squareness ratio corresponds to a large degree of demagnetization. A small squareness ratio also increases the magnetic field intensity required for magnetization. In addition, due to problems with the shape of the second quadrant of the magnetic hysteresis loop when a rare earth magnet has a small squareness ratio, it therefore tends to be less versatile as a magnet.

The C (carbon) content of the rare earth magnet is 0.03-0.15 wt %. If the C content is too low, the soft magnetic $R_2T_{17}$ phase will be deposited in the grain boundary phase, thus lowering the HcJ value. If it is too high, the squareness ratio will be lowered.

The rare earth magnet may also contain Ga as a major constituent element in addition to the elements mentioned above. In this case, the Ga content is preferably greater than 0 wt % and no greater than 0.2 wt %, and more preferably 0.05-0.15 wt %. The contents of the other constituent elements are the same as specified above even when Ga is added. When the rare earth magnet has a composition that contains Ga, it is believed that the Ga is able to enhance the anisotropic magnetic field of the main phase, thus tending to increase the HcJ value. Including Ga also tends to stabilize HcJ at a high level with respect to fluctuations in the amount of B within the optimal B content range. An excessive Ga content outside of this preferred range will tend to reduce the saturation magnetization and lower the Br content. Also, because of the relatively high cost of Ga, it is preferably used in as small an amount as necessary from the viewpoint of cost reduction.

As mentioned above, the rare earth magnet of this embodiment is formed primarily of a main phase having the composition represented by $R_2T_{14}B$, but when Dy is included as R, the structure is preferably a core-shell structure wherein the area near the outer periphery of the main phase is a phase with a high Dy content (shell) while the interior is a phase with a low Dy content (core). With such a core-shell structure, it is possible to achieve both a high HcJ value due to the shell section which has a high Dy content, and a high Br value due to the core section which has a low Dy content, so that excellent HcJ and Br values are both obtained. In particular, given that Dy is an expensive element, employing such a core-shell structure is effective for reducing costs since a high HcJ value is obtained while minimizing the amount of Dy. In addition, this core-shell structure tends to form more readily in the composition of a rare earth magnet according to this embodiment, and especially a composition that has low B and O contents and contains Cu.

A process for production of a rare earth magnet according to the embodiment described above will now be explained.

For production of the rare earth magnet, first the starting metals for each constituent element of the rare earth magnet are prepared and used for strip casting or the like to produce a starting alloy. The starting metals may be, for example, rare earth metals, rare earth alloys, pure iron, ferroboron or alloys thereof. These are used to produce a starting alloy that will yield the desired composition for the rare earth magnet. Starting alloys with different compositions may also be prepared.

The starting alloy is then ground to obtain a starting alloy powder. Grinding of the starting alloy is preferably carried out in stages, with a coarse grinding step and fine grinding step. The coarse grinding step may be carried out in an inert gas atmosphere using, for example, a stamp mill, jaw crusher, Braun mill or the like. Hydrogen absorption grinding where grinding is conducted after adsorption of hydrogen also be carried out In the coarse grinding step, the starting alloy is ground to a particle size of about several hundred μm.

In the subsequent fine grinding step, the ground product obtained from the coarse grinding step is subjected to fine grinding to a mean particle size of 3-5 μm. The fine grinding may be carried out using a jet mill, for example. The grinding of the starting alloy does not necessarily need to be carried out in two stages of coarse grinding and fine grinding, and instead the fine grinding step may be carried out from the beginning. When different types of starting alloys are prepared, they may be separately ground and then combined.

The starting powder obtained in this manner is then molded in a magnetic field to obtain a compact. More specifically, the starting powder is packed into a die placed in an electromagnet, and then molding is accomplished by applying a magnetic field with an electromagnet to pressurize the starting powder while orienting the crystal axes of the starting powder. This magnetic field molding may be carried out in a magnetic field of 12.0-17.0 kOe, at a pressure of about 0.7 $t/cm^2$-1.5 $t/cm^2$.

After the magnetic field molding, the compact is fired in a vacuum or an inert gas atmosphere to obtain a sintered compact. The firing conditions are preferably set as appropriate for the composition, the grinding method and the particle size, and the firing may be carried out at 1000-1100° C. for 1-5 hours, for example.

The sintered compact may also be subjected to aging treatment if necessary to obtain the rare earth magnet. Aging treatment tends to improved the HcJ value of the obtained rare earth magnet. Aging treatment is preferably carried out in two stages, for example, under two different temperature conditions such as near 800° C. and near 600° C. Aging treatment under such conditions will tend to result in a particularly excellent HcJ value. When aging treatment is carried out in a single step, it is preferably at a temperature of near 600° C.

A preferred embodiment of the rare earth magnet and a process for its production were explained above, and as already mentioned, since the rare earth magnet of this embodiment has a low B content, formation of a B-rich phase is inhibited, thus increasing the proportion of the $R_2T_{14}B$ main phase and resulting in an excellent Br value. Also, because the rare earth magnet contains Cu, formation of the soft magnetic $R_2T_{17}$ phase is inhibited despite the low B content, so that a high HcJ value is obtained as a result. In addition, since the rare earth magnet of this embodiment has a low O content, it essentially has a high R content and therefore has an increased R-rich phase that contributes to the HcJ value, with $R_2T_{14}B$ phase or $R_2T_{14}C$ phase formation being favored so that formation of the $R_2T_{17}$ is further inhibited. As a result, an especially notable improving effect on the Br and HcJ values is obtained.

EXAMPLES

The present invention will now be explained in greater detail through the following examples, with the understanding that these examples are in no way (imitative on the invention.

[Production of Rare Earth Magnets]

Examples 1-23, Comparative Examples 1-9

First, the starting metals for the rare earth magnet were prepared and used for strip casting to produce starting alloys for the compositions of the rare earth magnets of Examples 1-23 and Comparative Examples 1-9 listed in Table 1 below.

Hydrogen was then absorbed in the obtained starting alloys, and hydrogen grinding was carried out by dehydrogenation at 600° C. for 1 hour in an Ar atmosphere. For these examples, each of the steps from the hydrogen grinding to firing (the fine grinding and molding steps) were carried out in an atmosphere with an oxygen concentration of less than 100 ppm.

Next, 0.15 wt % oleic acid amide was added as a grinding aid to the hydrogen ground powder, and after using a Nauta mixer for 5-30 minutes of mixing, a jet mill was used for fine grinding to obtain a starting powder with a mean particle size of 3 μm.

The starting powder was then packed into a die placed in an electromagnet and magnetic field molding was carried out by applying a pressure of 1.2 $t/cm^2$ in a magnetic field of 15 kOe, to obtain a compact. The compact was then fired at 1030° C. for 4 hours in a vacuum and rapidly cooled to obtain a sintered compact. The obtained sintered compact was subjected to two-stage aging treatment at 850° C. for 1 hour and at 540° C. for 2 hours (both in an Ar atmosphere), to obtain rare earth magnets for Examples 1-23 and Comparative Examples 1-9.

[Evaluation of Physical Properties]

(Measurement of Br, HcJ and Hk/HcJ)

The rare earth magnets obtained in Examples 1-23 and Comparative Examples 1-9 were measured using a B-H tracer to determine the Br (residual flux density), HcJ (coercive force) and Hk/HcJ (squareness ratio). The results are summarized in Table 1.

TABLE 1

| Rare earth magnet | Composition | | | | | | | | | | | | Properties | | |
|---|---|---|---|---|---|---|---|---|---|---|---|---|---|---|---|
| | Nd [wt %] | Dy content [wt %] | R content (= Nd + Dy) [wt %] | Fe [wt %] | Co [wt %] | Al [wt %] | Cu [wt %] | Zr [wt %] | B [wt %] | O [wt %] | C [wt %] | N [wt %] | Br [kG] | HcJ [kOe] | Hk/HcJ [%] |
| Comp. Ex. 1 | 25.3 | 5.0 | 30.2 | Remainder | 0.5 | 0.2 | 0.07 | 0.19 | 1.00 | 0.053 | 0.12 | 0.05 | 13.23 | 23.78 | 96 |
| Example 1 | 25.2 | 4.9 | 30.1 | Remainder | 0.5 | 0.2 | 0.07 | 0.19 | 0.97 | 0.051 | 0.12 | 0.05 | 13.27 | 24.62 | 95 |
| Example 2 | 25.1 | 4.9 | 30.1 | Remainder | 0.5 | 0.2 | 0.07 | 0.19 | 0.94 | 0.047 | 0.11 | 0.05 | 13.29 | 24.69 | 95 |
| Example 3 | 25.3 | 4.9 | 30.3 | Remainder | 0.5 | 0.2 | 0.07 | 0.19 | 0.92 | 0.047 | 0.11 | 0.05 | 13.31 | 25.68 | 91 |
| Example 4 | 25.1 | 4.9 | 30.0 | Remainder | 0.5 | 0.2 | 0.07 | 0.19 | 0.90 | 0.050 | 0.10 | 0.05 | 13.33 | 26.22 | 92 |
| Example 5 | 25.5 | 4.9 | 30.4 | Remainder | 0.5 | 0.2 | 0.07 | 0.19 | 0.87 | 0.048 | 0.12 | 0.05 | 13.26 | 24.31 | 92 |
| Comp. Ex. 2 | 25.2 | 4.9 | 30.1 | Remainder | 0.5 | 0.2 | 0.07 | 0.19 | 0.84 | 0.049 | 0.13 | 0.05 | 13.24 | 23.51 | 91 |
| Comp. Ex. 3 | 25.3 | 4.9 | 30.2 | Remainder | 0.5 | 0.2 | 0.07 | 0.19 | 0.97 | 0.213 | 0.12 | 0.05 | 13.21 | 24.10 | 95 |
| Comp. Ex. 4 | 25.3 | 4.9 | 30.2 | Remainder | 0.5 | 0.2 | 0.07 | 0.19 | 0.94 | 0.218 | 0.11 | 0.05 | 13.25 | 24.09 | 95 |
| Comp. Ex. 5 | 25.2 | 4.9 | 30.1 | Remainder | 0.5 | 0.2 | 0.07 | 0.19 | 0.91 | 0.220 | 0.12 | 0.05 | 13.25 | 24.13 | 93 |
| Comp. Ex. 6 | 25.2 | 4.9 | 30.2 | Remainder | 0.5 | 0.2 | 0.07 | 0.19 | 0.90 | 0.216 | 0.12 | 0.05 | 13.26 | 24.10 | 92 |
| Comp. Ex. 7 | 25.2 | 4.9 | 30.2 | Remainder | 0.5 | 0.2 | 0.07 | 0.19 | 0.90 | 0.503 | 0.12 | 0.05 | — | — | — |
| Comp. Ex. 8 | 25.3 | 4.9 | 30.2 | Remainder | 0.5 | 0.2 | 0.00 | 0.19 | 0.90 | 0.049 | 0.12 | 0.05 | 13.44 | 23.90 | 63 |
| Example 6 | 25.3 | 4.9 | 30.2 | Remainder | 0.5 | 0.2 | 0.03 | 0.19 | 0.90 | 0.050 | 0.12 | 0.05 | 13.39 | 26.03 | 91 |
| Example 7 | 25.3 | 4.9 | 30.2 | Remainder | 0.5 | 0.2 | 0.10 | 0.19 | 0.90 | 0.049 | 0.12 | 0.05 | 13.26 | 26.31 | 95 |
| Comp. Ex. 9 | 25.2 | 4.9 | 30.2 | Remainder | 0.5 | 0.2 | 0.18 | 0.19 | 0.90 | 0.050 | 0.13 | 0.05 | 13.17 | 26.48 | 97 |
| Example 8 | 25.2 | 4.9 | 30.1 | Remainder | 0.5 | 0.2 | 0.07 | 0.19 | 0.91 | 0.062 | 0.11 | 0.05 | 13.32 | 25.87 | 92 |
| Example 9 | 25.1 | 4.9 | 30.0 | Remainder | 0.5 | 0.2 | 0.07 | 0.19 | 0.90 | 0.093 | 0.11 | 0.05 | 13.29 | 25.23 | 93 |
| Example 10 | 25.2 | 4.9 | 30.1 | Remainder | 0.5 | 0.2 | 0.07 | 0.19 | 0.96 | 0.036 | 0.11 | 0.05 | 13.28 | 25.01 | 96 |
| Example 11 | 25.1 | 4.9 | 30.0 | Remainder | 0.5 | 0.2 | 0.07 | 0.19 | 0.93 | 0.037 | 0.11 | 0.05 | 13.36 | 26.31 | 96 |
| Example 12 | 25.3 | 4.9 | 30.2 | Remainder | 0.5 | 0.2 | 0.07 | 0.19 | 0.90 | 0.037 | 0.10 | 0.05 | 13.41 | 27.42 | 95 |
| Example 13 | 25.1 | 4.9 | 30.0 | Remainder | 0.5 | 0.2 | 0.07 | 0.19 | 0.88 | 0.036 | 0.11 | 0.05 | 13.31 | 25.18 | 94 |
| Example 14 | 23.1 | 4.9 | 28.0 | Remainder | 0.5 | 0.2 | 0.07 | 0.19 | 0.90 | 0.051 | 0.10 | 0.05 | 13.26 | 24.53 | 90 |
| Example 15 | 30.9 | 3.1 | 34.0 | Remainder | 0.5 | 0.2 | 0.07 | 0.19 | 0.90 | 0.049 | 0.10 | 0.05 | 13.26 | 24.62 | 90 |
| Example 16 | 25.1 | 4.9 | 30.0 | Remainder | 2.5 | 0.2 | 0.07 | 0.19 | 0.90 | 0.051 | 0.10 | 0.05 | 13.31 | 25.88 | 93 |
| Example 17 | 25.1 | 4.9 | 30.0 | Remainder | 0.3 | 0.2 | 0.07 | 0.19 | 0.90 | 0.052 | 0.10 | 0.05 | 13.29 | 25.73 | 92 |
| Example 18 | 25.1 | 4.9 | 30.0 | Remainder | 0.5 | 0.3 | 0.07 | 0.19 | 0.90 | 0.047 | 0.10 | 0.05 | 13.25 | 26.75 | 92 |
| Example 19 | 25.1 | 4.9 | 30.0 | Remainder | 0.5 | 0.05 | 0.07 | 0.19 | 0.90 | 0.052 | 0.10 | 0.05 | 13.35 | 25.03 | 91 |
| Example 20 | 25.1 | 4.9 | 30.0 | Remainder | 0.5 | 0.2 | 0.07 | 0.25 | 0.90 | 0.050 | 0.10 | 0.05 | 13.25 | 25.80 | 92 |
| Example 21 | 25.1 | 4.9 | 30.0 | Remainder | 0.5 | 0.2 | 0.07 | 0.05 | 0.90 | 0.051 | 0.10 | 0.05 | 13.30 | 24.59 | 90 |
| Example 22 | 25.1 | 4.9 | 30.0 | Remainder | 0.5 | 0.2 | 0.07 | 0.19 | 0.90 | 0.051 | 0.15 | 0.05 | 13.27 | 25.58 | 91 |
| Example 23 | 25.1 | 4.9 | 30.0 | Remainder | 0.5 | 0.2 | 0.07 | 0.19 | 0.90 | 0.049 | 0.03 | 0.05 | 13.25 | 25.23 | 91 |

(Evaluation 1)

Figure 2:
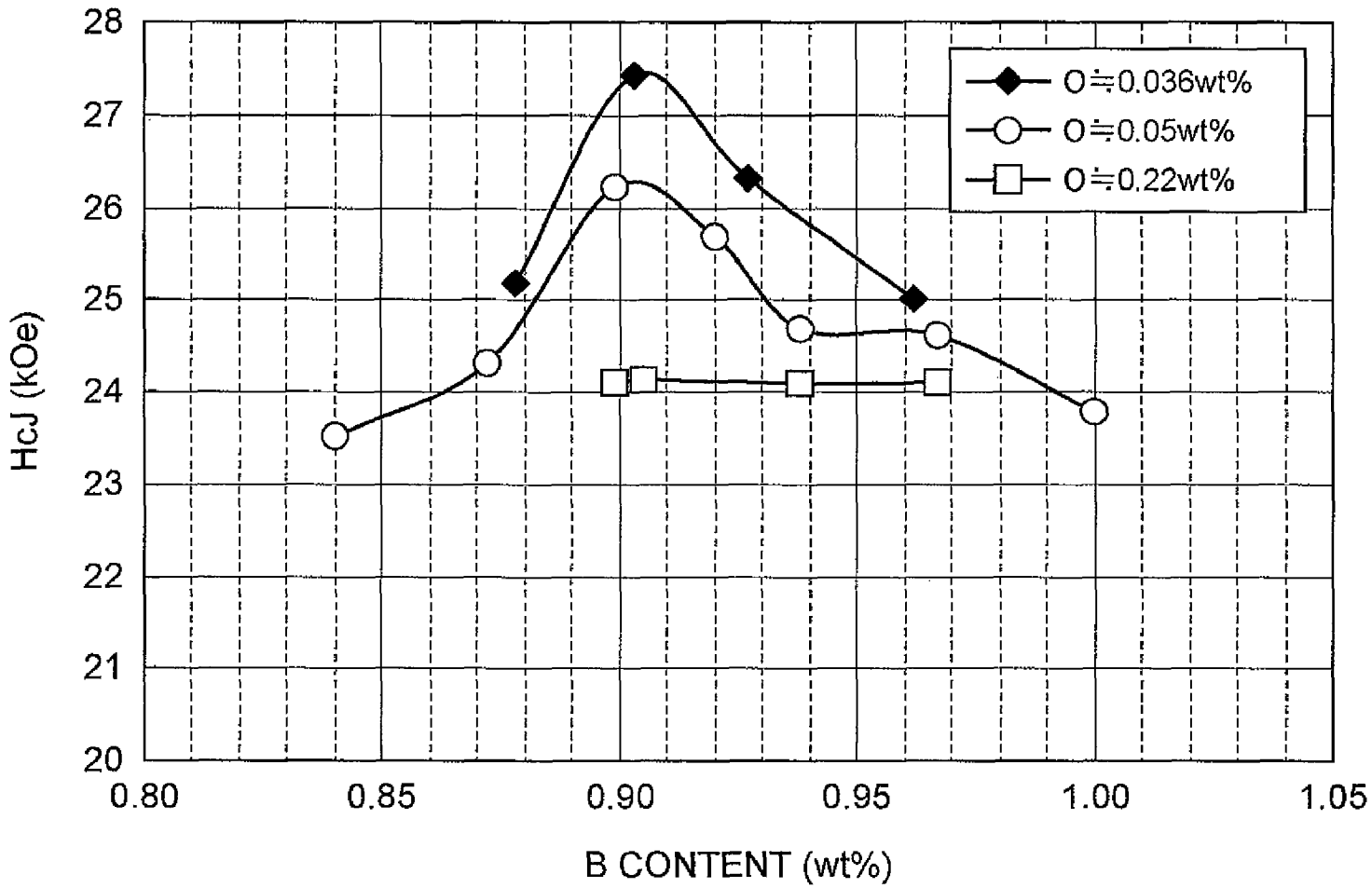
FIG. 2 is a graph showing a plot of HcJ values with respect to B content.

FIG. 1 shows a graph plotting the values of Br against B content and FIG. 2 shows a graph plotting the values of HcJ against B content, for the rare earth magnets with O contents of 0.05 wt % and different B contents in the range of 0.84-1.00 (Comparative Examples 1, 2 and Examples 1-5), and for the rare earth magnets with O contents of 0.036 wt % and different B contents in the range of 0.88-0.96 (Examples 10-13). In these graphs, the Br and HcJ values with respect to B content for the rare earth magnets having an O content of 0.21 or 0.22 wt % (represented as "~0.22 wt %") and different B contents in the range of 0.90-0.97 (Comparative Examples 3-6), are also plotted in the graph for comparison.

FIG. 1 and FIG. 2 confirm that a small O content of 0.036 wt % or 0.05 wt % improves the Br and HcJ values when the B content is in a specified range less than 1 wt % (for example, 0.85-0.98 wt %). On the other hand, an O content of about 0.22 wt % did not produce such an improving effect on the Br and HcJ values.

This confirmed that excellent Br and HcJ values are both achieved when the O content is low and the B content is in a specified range less than 1 wt %. The rare earth magnet of Comparative Example 7 had an O content of 0.50 wt %, but its density was low and the magnetic properties were unmeasurably low.

(Evaluation 2)

Figure 3:
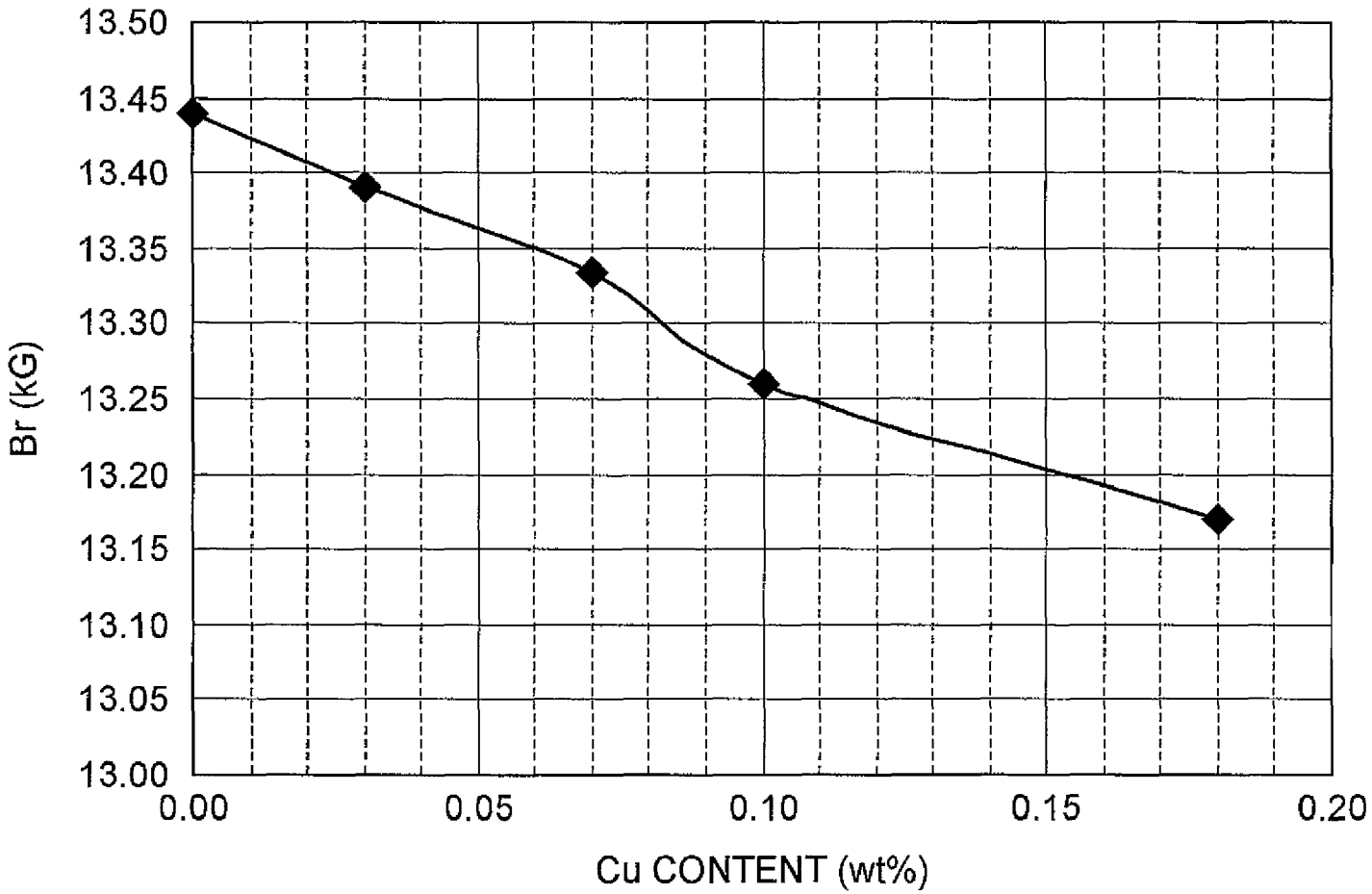
FIG. 3 is a graph showing a plot of Br values with respect to Cu content.
Figure 4:
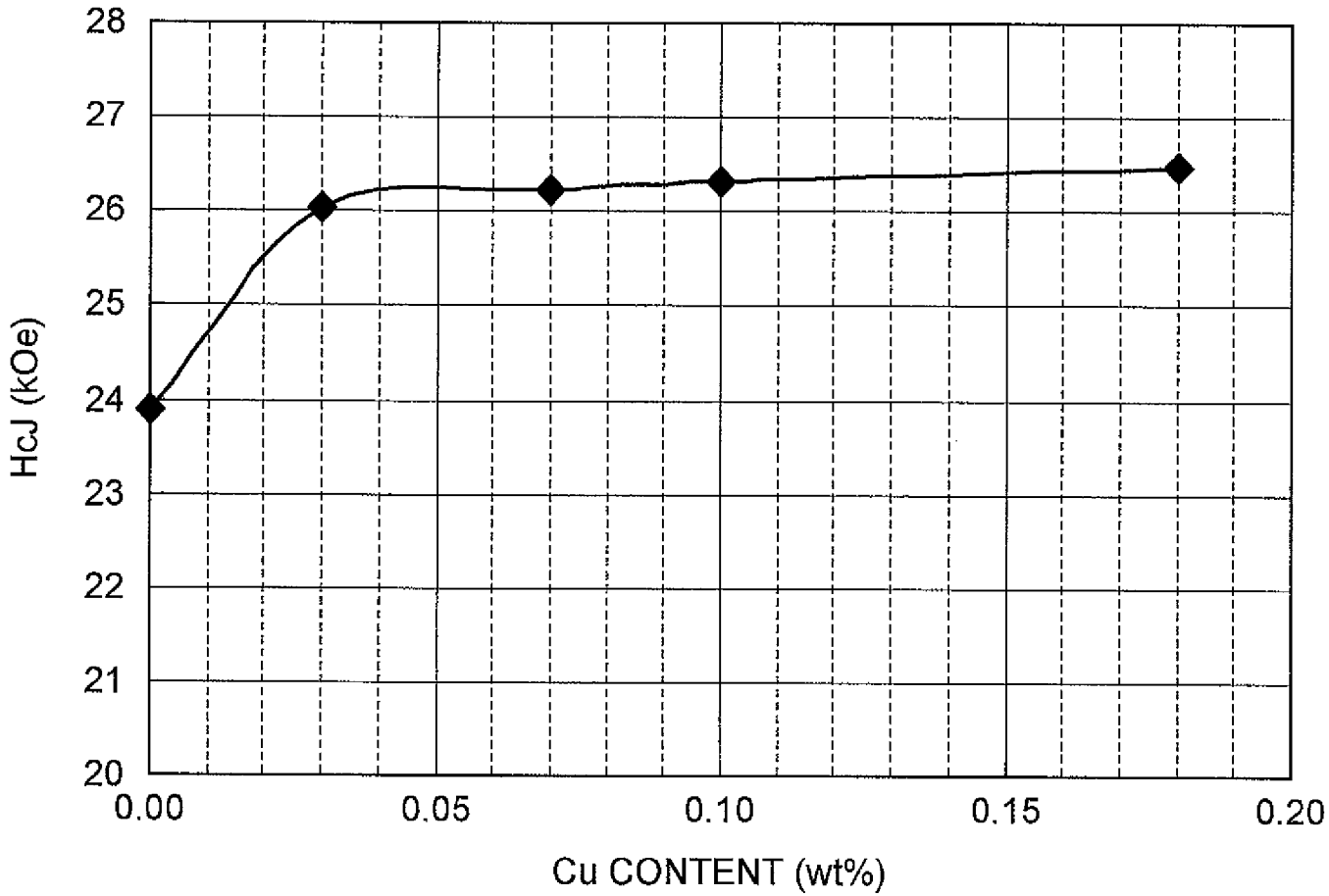
FIG. 4 is a graph showing a plot of HcJ values with respect to Cu content.

FIG. 3 shows a graph plotting Br values and FIG. 4 shows a graph plotting HcJ values, with respect to Cu content for the rare earth magnets with different Cu contents in the range of 0.00-0.18 (Examples 4, 6 and 7 and Comparative Examples 8 and 9).

FIGS. 3 and 4 confirm that a high Cu content lowers the Br value, whereas an excessively low Cu content lowers the HcJ value. It was confirmed, therefore, that a rare earth magnet can exhibit both excellent Br and HcJ values if it contains at least Cu and if the Cu content is not too high (for example, up to 0.15 wt %).

(Evaluation 3)

Figure 5:
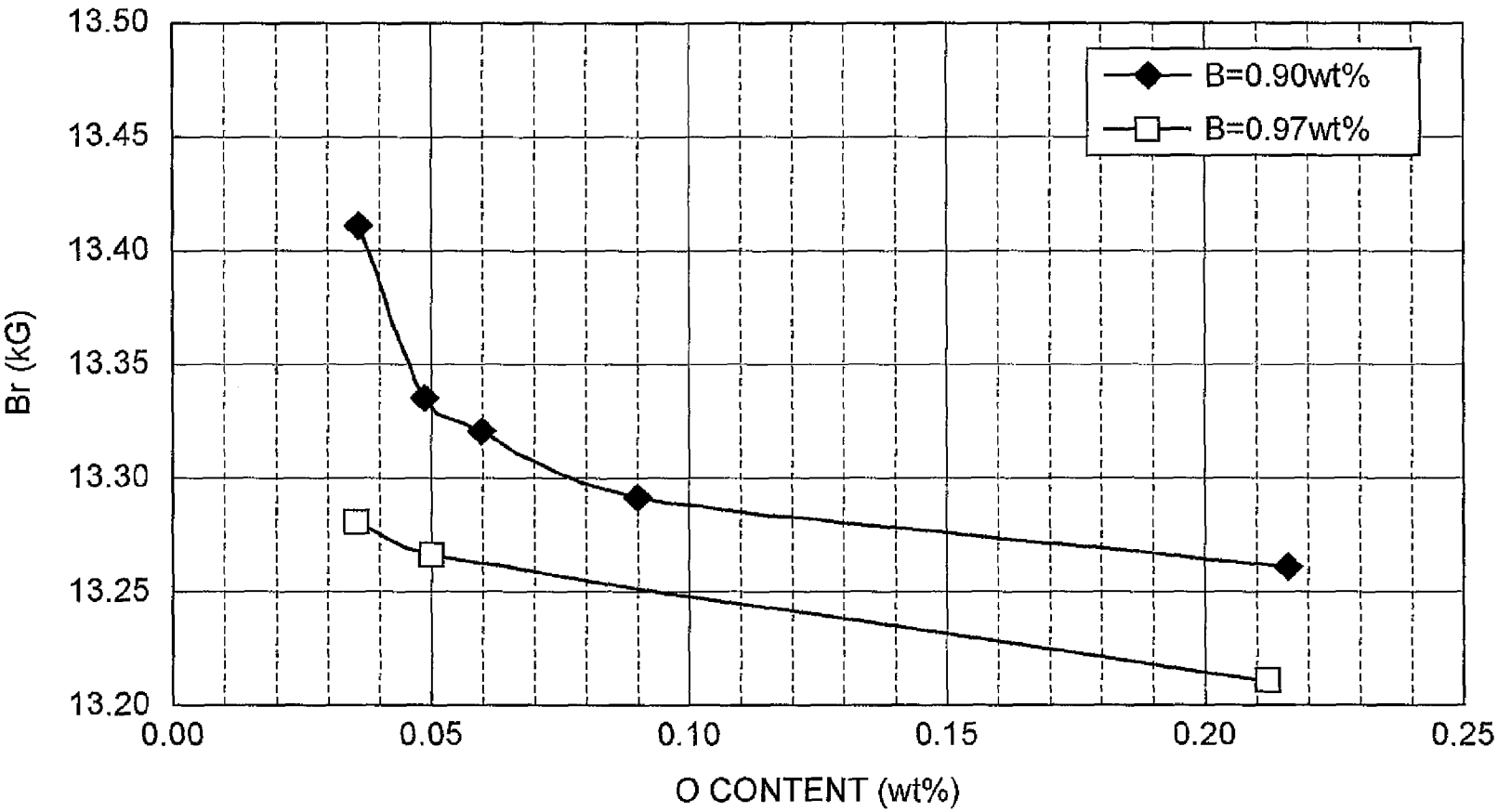
FIG. 5 is a graph showing a plot of Br values with respect to O content.
Figure 6:
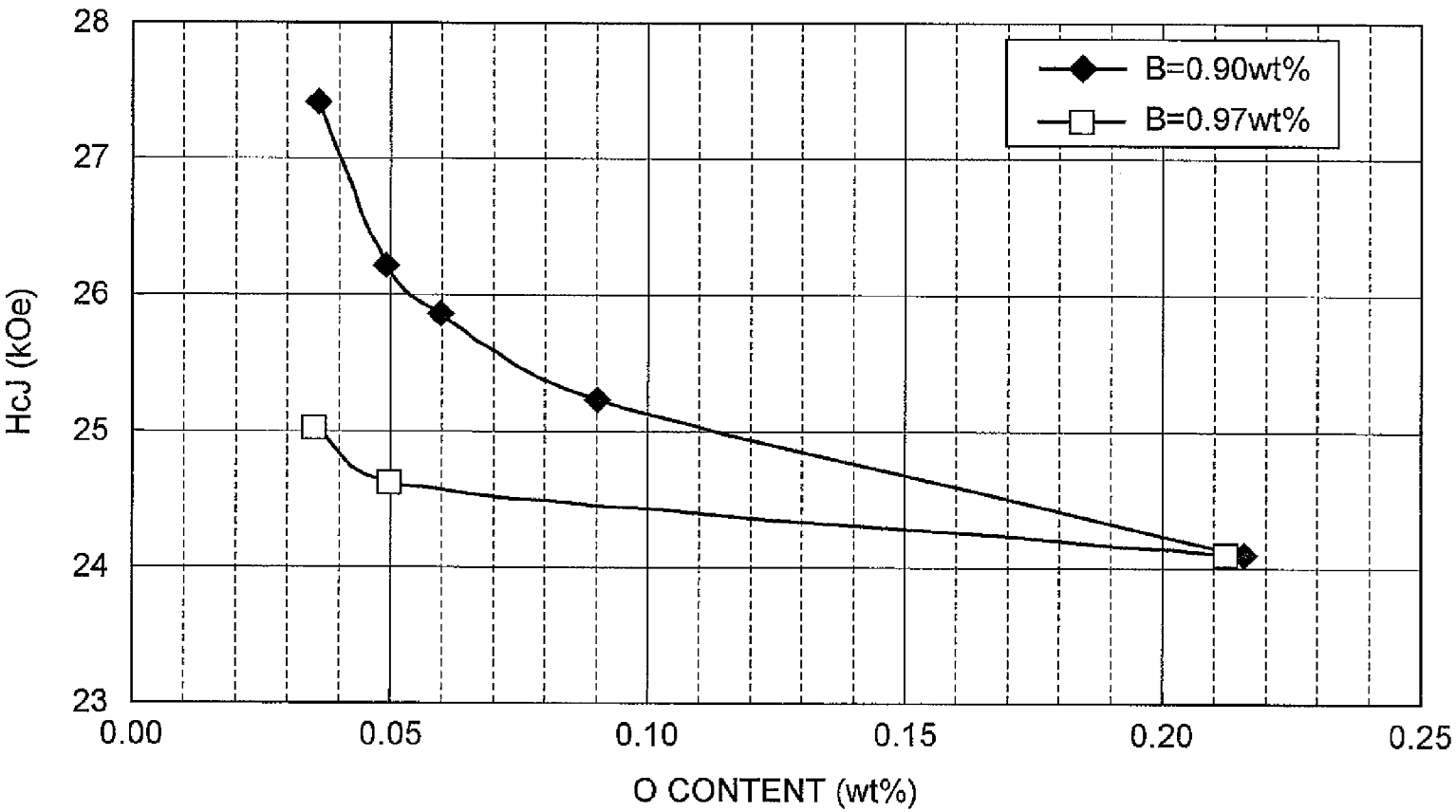
FIG. 6 is a graph showing a plot of HcJ values with respect to O content.

FIG. 5 shows a graph plotting Br values and FIG. 6 shows a graph plotting HcJ values with respect to O content, for rare earth magnets with a B content of 0.90 wt % and different O contents in the range of 0.037-0.22 (Examples 4, 8, 9 and 12, and Comparative Example 6), and rare earth magnets with a B content of 0.96 or 0.97 wt % (both indicated as "0.97 wt %") and different O contents in the range of 0.036-0.21 (Examples 1 and 10, and Comparative Example 3).

FIGS. 5 and 6 confirm that the Br and HcJ values are both low with increasing O content. These results also demonstrated, therefore, that excellent Br and HcJ values are obtained when the O content is low (especially no greater than 0.1 wt %). Also, while the Br and HcJ values increase with lower O content, the degree of increase is greater with a B content of 0.90 wt % than 0.97 wt %.

[Production of Rare Earth Magnets]

Examples 24-28

Rare earth magnets for Examples 24-28 were produced in the same manner as Example 1, except that the compositions for Examples 24-28 were as listed in Table 2 below. These magnets had compositions also containing Ga as a main constituent element, in addition to the composition of Example 1.

[Evaluation of Physical Properties]

(Measurement of Br, HcJ and Hk/HcJ)

The Br (residual flux density), HcJ (coercive force) and Hk/HcJ (squareness ratio) values of the rare earth magnets obtained in Examples 24-28 were measured in the same manner as Example 1. The results are summarized in Table 2.

TABLE 2

| Rare earth magnet | Composition | | | | | | | | | | | | | Properties | | |
|---|---|---|---|---|---|---|---|---|---|---|---|---|---|---|---|---|
| | Nd [wt %] | Dy content [wt %] | R content (= Nd + Dy) [wt %] | Fe [wt %] | Co [wt %] | Al [wt %] | Cu [wt %] | Zr [wt %] | Ga [wt %] | B [wt %] | O [wt %] | C [wt %] | N [wt %] | Br [kG] | HcJ [kOe] | Hk/HcJ [%] |
| Example 24 | 25.3 | 4.9 | 30.2 | Remainder | 0.5 | 0.2 | 0.07 | 0.19 | 0.14 | 0.88 | 0.051 | 0.12 | 0.05 | 13.27 | 25.92 | 95 |
| Example 25 | 25.3 | 4.9 | 30.2 | Remainder | 0.5 | 0.2 | 0.07 | 0.19 | 0.14 | 0.90 | 0.051 | 0.12 | 0.05 | 13.33 | 27.12 | 95 |
| Example 26 | 25.2 | 4.9 | 30.2 | Remainder | 0.5 | 0.2 | 0.07 | 0.19 | 0.14 | 0.94 | 0.047 | 0.12 | 0.05 | 13.31 | 26.04 | 95 |
| Example 27 | 25.3 | 4.9 | 30.2 | Remainder | 0.5 | 0.2 | 0.07 | 0.19 | 0.05 | 0.90 | 0.050 | 0.12 | 0.05 | 13.33 | 26.73 | 95 |
| Example 28 | 25.3 | 4.9 | 30.2 | Remainder | 0.5 | 0.2 | 0.07 | 0.19 | 0.20 | 0.90 | 0.048 | 0.12 | 0.05 | 13.29 | 27.22 | 95 |

Table 2 confirms that the rare earth magnets having compositions containing Ga had especially improved HcJ values compared to the same compositions without Ga (for example, Examples 2, 4 and 5).

The invention claimed is:

1. A rare earth including a main phase magnet characterized by being composed mainly of R (where R is at least one element selected from among rare earth elements including Y, and R includes Nd and Dy as an essential element), B, Al, Cu, Zr, Co, O, C and Fe, wherein the content of each element is as follows:

R: 25-34 wt % (where Dy content is 0.1-8 wt %)

B: 0.85-0.98 wt %

Al: 0.03-0.3 wt %

Cu: 0.03-0.11 wt %

Zr: 0.03-0.25 wt %

Co: ≦3 wt % (but not 0 wt %)

O: 0.03-0.1 wt %

C: 0.03-0.15 wt %

Fe: remainder.

2. A rare earth including a main phase magnet characterized by being composed mainly of R (where R is at least one element selected from among rare earth elements including Y, and R includes Nd and Dy as an essential component), B, Al, Cu, Zr, Co, O, C, Fe and Ga, wherein the content of each element is as follows:

R: 25-34 wt % (where Dy content is 0.1-8 wt %)

B: 0.85-0.98 wt %

Al: 0.03-0.3 wt %

Cu: 0.03-0.11 wt %

Zr: 0.03-0.25 wt %

Co: ≦3 wt % (but not 0 wt %)

O: 0.03-0.1 wt %

C: 0.03-0.15 wt %

Ga: ≦0.2 wt % (but not 0 wt %)

Fe: remainder.

3. A rare earth magnet according to claim 1, having a core-shell structure wherein the area near the outer periphery of the main phase is a phase with a high Dy content while the interior is a phase with a low Dy content.

4. A rare earth magnet according to claim 2, having a core-shell structure wherein the area near the outer periphery of the main phase is a phase with a high Dy content while the interior is a phase with a low Dy content.

* * * * *